United States Patent [19]

Fulghum

[11] Patent Number: 4,993,081

[45] Date of Patent: Feb. 19, 1991

[54] FLEXIBLE SUN SHIELD

[76] Inventor: David D. Fulghum, 9009 9th Ave. NW., Bradenton, Fla. 34209

[21] Appl. No.: 486,509

[22] Filed: Feb. 28, 1990

[51] Int. Cl.[5] ..... A42B 1/06

[52] U.S. Cl. ..... 2/191

[58] Field of Search ..... 2/177, 185 R, 191, 410, 2/422, 10, 12

[56] References Cited

U.S. PATENT DOCUMENTS

| | | | |
|---|---|---|---|
| 1,826 | 6/1869 | Moss | 2/191 |
| 770,352 | 9/1904 | Cleveland | 2/191 |
| 2,416,062 | 2/1947 | Mercer | 2/177 |
| 4,258,437 | 3/1981 | Sawatsky | 2/12 |
| 4,873,726 | 10/1989 | Tapia | 2/12 |

OTHER PUBLICATIONS

Journal of AMA, vol. 168, No. 7, Oct. 18, 1958, Gershman, Maurice, "Self-Adhering Nylon Tapes".

*Primary Examiner*—Werner H. Schroeder
*Assistant Examiner*—Amy B. Vanatta
*Attorney, Agent, or Firm*—Charles J. Prescott

[57] ABSTRACT

A flexible sun shield detachably connectable around the circumference of a hard hat or military helmet for shielding eyes, face and neck from excessive sun exposure. The sun shield includes a brim formed of a curved length of flexible, pliable flat material formed generally into the shape of a portion of an oval ring in-the-flat and an upstanding flexible flange connected along the inner margin of the brim. The flange is releasably connectable circumferentially around the hard hat such that the brim extends outwardly and slopes downwardly from the hard hat.

10 Claims, 2 Drawing Sheets

CH
2
16
10
14
20
22
24, 26
12
2

CH
18
16
14
10
12
B
A
20
10
14
16
12

10
16
12
14
26
22
20
24
CH

CH
14
16
5
10
18
12
C
C
18
22
5

44
46
48
50
52
52
48
56
54
50

FLEXIBLE SUN SHIELD

This invention relates generally to removable brims for hats and, more particularly to a removable, flexible sun shield releasably connectable to hard hats and military helmets.

I have practiced dermatology in central Florida for over twenty years. During that period, I have treated numerous skin cancers and now treat them on a daily basis. Patients whose avocations and occupations result in sun exposure are particularly at risk for developing cancer. Wide brimmed hats provide effective protection when worn by those exposed to the sun. For those who are required to wear a hard hat or military helmets, sun exposure to the face, eyes and neck is uninhibited since these types of head gear do not include a built in brim.

I am aware of the invention by Hild disclosed in U.S. Pat. No. 4,316,289 which is directed to a rigid, removable sun shield for a hard hat. However, this rigidity results in jostling of the wearer's head when fixed objects are bumped by the unyielding brim. A severe impact with a fixed object may also result in an exaggeration of injuries to the head and may even result in a more serious accident if the user loses balance and falls.

My invention is directed to a circular or oval shaped of flexible cloth or fibrous detachable brim which is made connectable circumferentially around a hard hat or military helmet. Connections may be made by two-part snaps, Velcro fasteners, an adhesive strip or elastic. My flexible brim invention, when attached to a hard hat, will provide complete shading of the face, neck and eyes that will flex when accidentally bumped so as not to dislodge or jostle the protective head gear.

BRIEF SUMMARY OF THE INVENTION

This invention is directed to a flexible sun shield detachably connectable around the circumference of a hard hat or military helmet for shielding eyes, face and neck from excessive sun exposure. The sun shield includes a brim formed of a curved length of flexible, pliable flat material formed generally into the shape of a portion of an oval ring in-the-flat and an upstanding flexible flange connected along the inner margin of the brim. The flange is releasably connectable circumferentially around the hard hat such that the brim extends outwardly and slopes downwardly from the hard hat.

It is therefore an object of this invention to provide a flexible sun shield connectable to hard hats and military helmets which will shield the user's face, neck and eyes from excessive sun exposure.

It is another object of this invention to completely absorb and be deflected by impact with other objects so as not to dislodge or jostle the helmet from its proper position atop the user's head.

It is another object of this invention in one embodiment to be disposable after one time use.

In accordance with these and other objects which will become apparent hereinafter, the instant invention will now be described with reference to the accompanying drawings.

DETAILED DESCRIPTION OF THE INVENTION

Figures 1, 2, 3, 4, 5, 9:
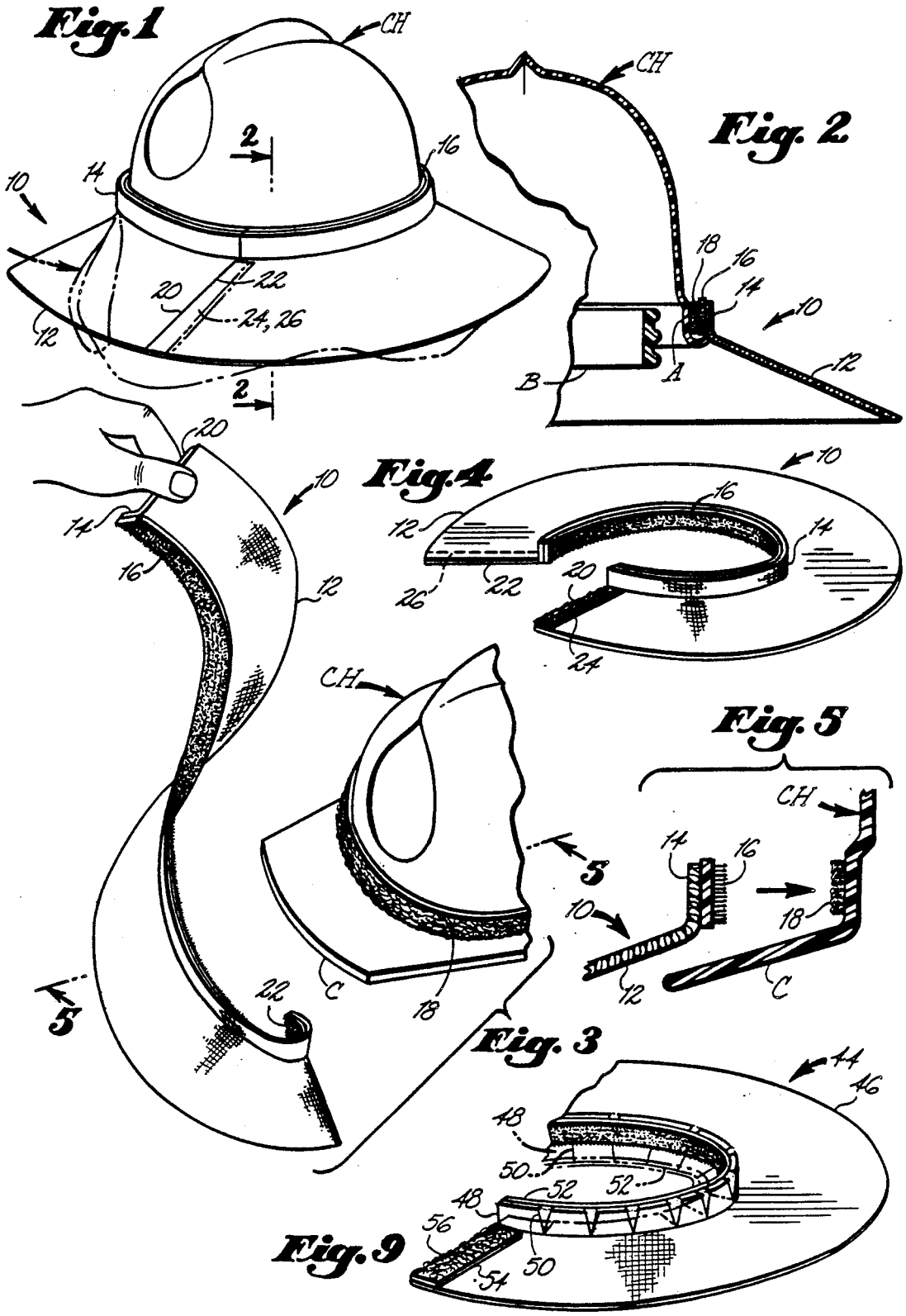
FIG. 1 is a perspective view of one embodiment of the invention shown connected circumferentially around a hard hat.
FIG. 2 is a section view in the direction of arrows 2—2 in FIG. 1.
FIG. 3 is a perspective view of the invention as shown in FIG. 1 being held ready for installation around a hard hat.
FIG. 4 is a perspective view of the invention shown in FIG. 1 in the flat.
FIG. 5 is a section view in the direction of arrows 5—5 in FIG. 3.
FIG. 9 is a partial perspective view of an alternate variation of the invention as shown in FIG. 4.

Referring now to the drawings, and particularly to FIGS. 1 to 5, the preferred embodiment of the invention is shown generally at numeral 10. This embodiment 10 includes a flexible brim 12 fabricated of a woven or fibrous material generally of a thickness so as to be flexible and pliable when impacted, but rigid enough to maintain the shape as shown in FIGS. 1 and 2 when attached around the circumference of a hard hat CH as used in the construction industry. These hard hats CH typically include a headband B connected circumferentially within the hard hat sized for each user's head.

Brim 12, as best seen in FIG. 4, is oval or ring-shaped in-the-flat having ends 20 and 22 and sized such that the oval ring is incomplete. Connected around the inner margin of brim 12 is an upstanding flange 14 fabricated of a similar woven or fibrous flexible material.

One strip 16 of a two part Velcro arrangement is connected around the inner surface of flange 14. The other mating Velcro strip 18 is connected around the circumference of the hard hat just above the lower margin or rim A of the hard hat CH. By this arrangement, then, the user, holding the device 10 as shown in FIG. 3, begins at one end 20 to releasably attach Velcro strip 16 to Velcro strip 18, continuing circumferentially around the entire hard hat CH so that the ends 20 and 22 of brim 12 meet and overlap slightly. A separate two part Velcro strip arrangement at 24 and 26 adjacent the ends 20 and 22, respectively, serve as a final connection to form a continuous sun shield around the hard hat CH.

Because of the configuration of brim 12 as previously described, when circumferentially connected around the hard hat CH, the brim 12 as installed has a downward, as well as an outward, slope for further enhanced sun shielding benefits as best seen in FIGS. 1 and 2.

Referring especially to FIG. 1, one of the primary benefits of the invention is there shown in phantom. When the brim 12 is struck by a fixed object such as a tree during normal body movement around such objects as, a portion of a building, a vehicle, building superstructure in construction or the like in the direction of the arrow, the entire brim 12 deflects as shown in phantom. Because of the flexibility of the material used in the brim 12, this flexing will continue as far as necessary all the way to where the fixed object might strike the rim A of hard hat CH itself. Thus, the construction worker wearing the invention 10 is fully comfortable in moving in unrestricted fashion as though he were not even wearing the invention 10 for sun shield protection, being able to move freely without concern for striking other objects.

Figure 6:
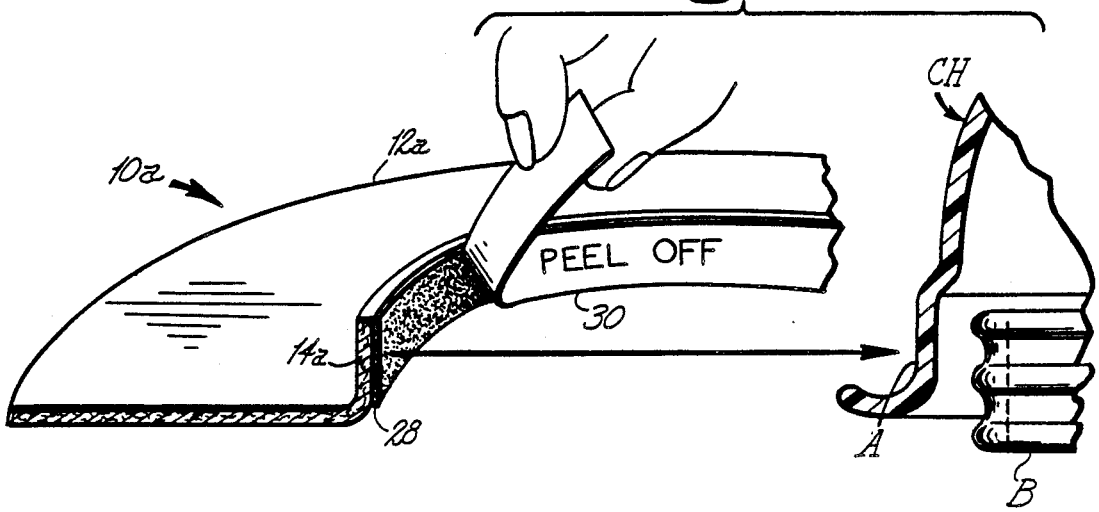
FIG. 6 is a perspective view of a portion of a disposable embodiment of the invention.

Referring now to FIG. 6, an alternate embodiment of the invention is shown generally at numeral 10a. This embodiment 10a includes a flexible brim 12a shaped and formed as previously described, and including upstanding brim 14a around its inner margin. However, in this embodiment 10a, a strip of adhesive 28 is connected to the inner surface of flange 14a. A removable paper cover 30 is also provided which may be peeled off just prior to installation circumferentially around the hard hat CH along A. This embodiment 10a is provided in situations Alternately, if the brim 10a and flange 12a are fabricated of heavy, yet flexible and pliable paper, the device may be disposable as well.

Figure 7:
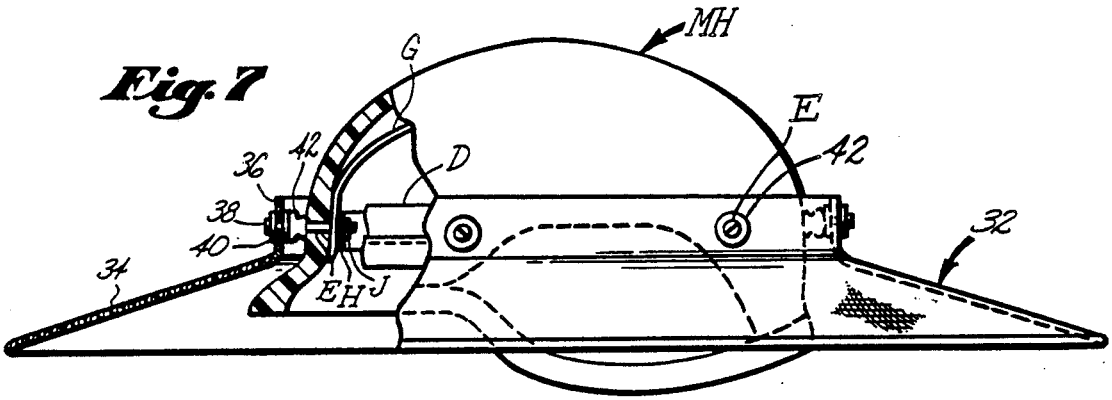
FIG. 7 is a side elevation partially broken view of another embodiment of the invention connected circumferentially around a military helmet.
Figure 8:
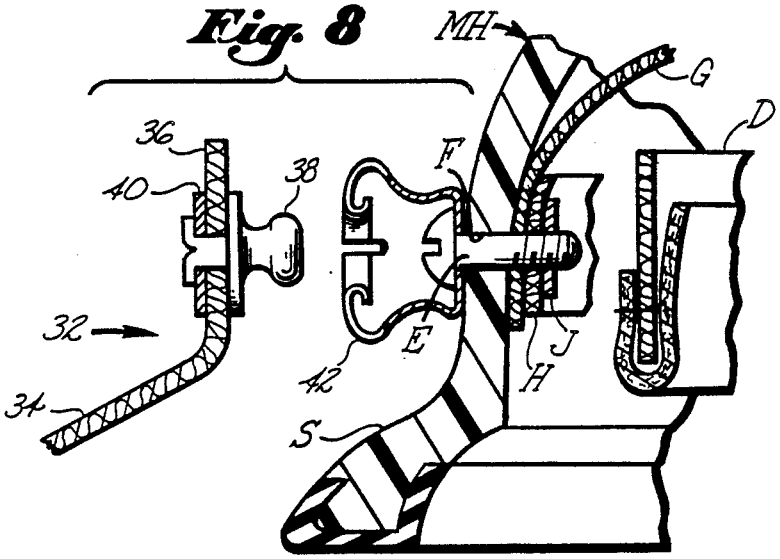
FIG. 8 is an enlarged section view of the two part connection arrangement shown in FIG. 7.

Referring now to FIGS. 7 and 8, another embodiment of the invention is shown generally at numeral 32. This embodiment 32 is intended for use in conjunction with a military helmet MH. These military helmets MH include a plurality of threaded fasteners E which threadably engage through holes F into nut J to sandwich and retain a suspension band having crown straps G and web strap H therebetween. Connected to the suspension band by clips is a headband D which protectively centers the user's head within the helmet shell S of the metal helmet MH.

This embodiment 32 includes flexible brim 34 having upstanding flange 36 shaped as previously described. However, this embodiment 32 also includes a plurality of male snap portions 38 which are staked within flange 36 and strengthened by washer 40 as best seen in FIG. 8. These male snap portions 38 releasably engage within female snap portions 42 which are held in place by the head of fastener E in the helmet shell S.

This arrangement thus utilizes the existing availability of fasteners E and obviates the need for additional attaching means. The two part snap fasteners 38 and 42 also provide for a stronger connection of this embodiment 32 to the military helmet MH to withstand the more abusive environment in which this embodiment 32 must operate without becoming detached from the military helmet MH.

Referring lastly to FIG. 9, another embodiment of the invention is shown generally at 44. This embodiment 44 is similar to that described and shown in FIG. 4 having brim 46 made as previously described. However, in this embodiment 44, the flange connected around the inner margin of brim 46 is segmented or cut at 50 to provide a plurality of flange segments 48. One portion of the Velcro strip 52 is connected to the inner surface (lower surface in phantom) of flange segments 48. Thus, as shown in phantom, the invention 44, prior to use, is fully in the flat. The flange segments 48 and Velcro strip 52 are then pliably bendable upwardly into an upstanding flange during installation. Velcro strip 54 along end 52 is matably engagable to form a continuous downwardly sloped outwardly extending brim connectable to the other end of brim 46 (not shown) as previously described.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A flexible sun shield detachably connectable to a hard hat comprising:

a brim formed of a curved length of flexible, pliable flat material formed generally into the shape of a portion of an oval ring in-the-flat having generally parallel, spaced inner and outer margins and spaced apart ends;

said brim being fully bendable and readily deformable in response to the imposition of force;

an upstanding flexible flange connected along substantially the entire length of said inner margin;

releasable attaching means for connecting said flange circumferentially around the hard hat, said brim extending downwardly and sloping outwardly from the hard hat forming a sun shade for the user's head, neck and eyes;

said brim having first and second ends which, when connected around the hard hat, overlap.

2. A flexible sun shield as set forth in claim 1, wherein:

said brim is continuous when connected circumferentially around the hard hat.

3. A flexible sunshield as set forth in claim 2, further comprising:

two-part connecting means for releasable connection of said first and second ends of said brim when said sun shield is connected circumferentially around the hard hat;

said two-part connecting means is releasably mating two-part hook and loop strips, one said strip being connected to said first end upper surface and the other said strip being connected to said second end lower surfaces.

4. A flexible sun shield as set forth in claim 2, wherein:

said releasable attaching means is releasably mating two-part hook and loop strips, one said strip connected to the inner surface of said flange and the other said strip connected circumferentially around the hard hat.

5. A flexible sun shield as set forth in claim 2, wherein:

said releasable attaching means is a plurality of releasably mating two-part male and female snap portions, each of said plurality of female snap portions connected in spaced apart arrangement circumferentially around the hard hat, each of said plurality of male snap portions connected in spaced apart arrangement along the inner surface of said flange.

6. A flexible sun shield as set forth in claim 5, wherein:

each of said plurality of female snap portions are connected to the hard hat by threaded fasteners which are a part of the hard hat used for retaining the suspension band and headband in place within the hard hat.

7. A flexible sun shield as set forth in claim 2, wherein:

said releasable attaching means is an adhesive strip connected to the inner surface of said flange and having a removable protective cover.

8. A flexible sun shield as set forth in claim 7, wherein:

said brim and said flange are formed of relatively heavy but flexible and pliable disposable paper.

9. A flexible sun shield as set forth in claim 7, wherein:

said flange is segmented and is in-the-flat with said brim when not in use.

10. A flexible sun shield as set forth in claim 7, wherein:

said sun shield is rollable for storage.

* * * * *

UNITED STATES PATENT AND TRADEMARK OFFICE

CERTIFICATE OF CORRECTION

PATENT NO. : 4,993,081

DATED : February 19, 1991

INVENTOR(S) : David D. Fulghum

It is certified that error appears in the above-identified patent and that said Letters Patent is hereby corrected as shown below:

Column 3, line 13, after "situations", insert -- where the user anticipates continual use of the sun shield 10a.--

Column 4, line 30, rewrite "surfaces" as -- surface --.

Signed and Sealed this

Thirtieth Day of June, 1992

*Attest:*

DOUGLAS B. COMER

*Attesting Officer*

*Acting Commissioner of Patents and Trademarks*